US007011084B2

(12) United States Patent
Richard

(10) Patent No.: US 7,011,084 B2
(45) Date of Patent: Mar. 14, 2006

(54) IMPETUS-MODIFYING THRUST-WHEELS FOR BALL-PITCHING MACHINES

(75) Inventor: J. Robert Richard, San Diego, CA (US)

(73) Assignee: Sports Products Consultants Inc., San Diego, CA (US)

( * ) Notice: Subject to any disclaimer, the term of this patent is extended or adjusted under 35 U.S.C. 154(b) by 303 days.

(21) Appl. No.: 10/622,823

(22) Filed: Jul. 21, 2003

(65) Prior Publication Data

US 2005/0016516 A1 Jan. 27, 2005

(51) Int. Cl.
*F41B 4/00* (2006.01)

(52) U.S. Cl. ..... 124/78

(58) Field of Classification Search ..... 124/6, 124/78, 80; 152/151, 209.8, 209.12, 209.17, 152/450; 301/62; 446/437
See application file for complete search history.

(56) References Cited

U.S. PATENT DOCUMENTS 957,165 A * 5/1910 Kempshall ..... 152/209.16
1,204,468 A * 11/1916 Marty ..... 124/6
2,715,299 A * 8/1955 Steitz ..... 65/535
2,716,973 A * 9/1955 Desi ..... 124/78
3,511,291 A * 5/1970 Ragan ..... 152/209.1
D223,015 S * 2/1972 Beyers ..... D12/525
3,712,359 A * 1/1973 Williams ..... 152/158
4,197,827 A 4/1980 Smith ..... 124/78
4,442,823 A 4/1984 Floyd ..... 124/78
4,575,354 A * 3/1986 Wakayama et al. ..... 446/437
4,632,088 A 12/1986 Bruce ..... 124/78
4,712,534 A 12/1987 Nozato ..... 124/78
4,760,835 A 8/1988 Paulson ..... 124/78
5,127,390 A * 7/1992 Paulson ..... 124/80
5,832,909 A 11/1998 Grant ..... 124/6
6,182,649 B1 2/2001 Battersby ..... 124/78

* cited by examiner

*Primary Examiner*—John A. Ricci

(57) ABSTRACT

The notion of an assymetrically configured thruster-wheel for automatic-feed ball-pitching batter/training-machines having a pair of laterally apposed axially-driven thruster-wheels; —wherein one or both thruster-wheels features a resilient circumferential-facing formed with declivities which can be regular or irregular protruding or receeding formations acting to alter the instant amount of impetus or thrust being exerted bilaterally upon the surface of a momentarily feeding ball. The thrust-wheels are axially readily detatchable from the ball-pitching thrust-motor shafts, thereby enabling coach or user to change just one or both thrust-wheels from a conventional uniform tread-surface (which thus always shoots-out balls on a predictable trajectory) to my new IM/Thrust-wheel which thereby shoots-out balls on a non-predictable trajectory. Accordingly, without the heretofore complexity of computer-controlled action, this simple improvement enables a practicing ball-batter to be pitched balls which randomly change on an unpredictable basis to pass virtually anywhere generally within the batter's strike-zone, thereby training the user to better cope with variously pitched balls.

8 Claims, 1 Drawing Sheet

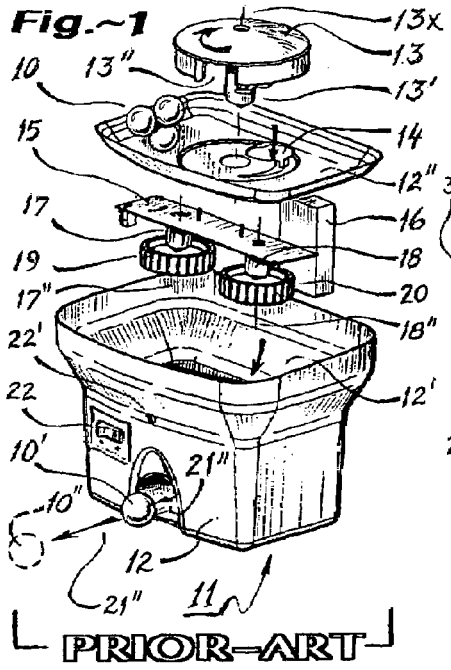
Fig.~1
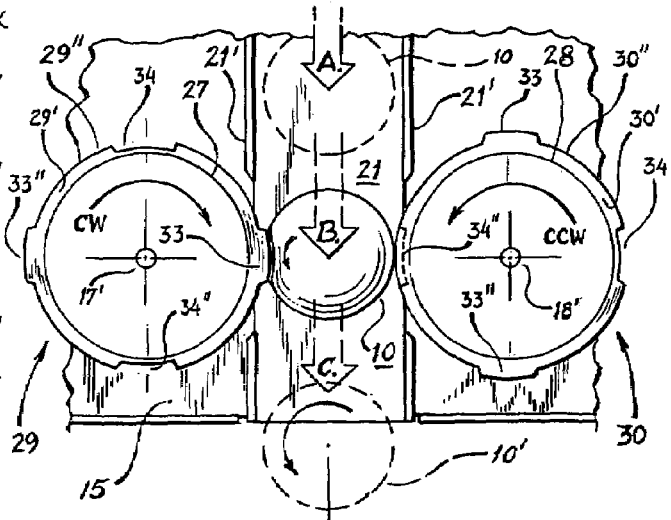
Fig.~2
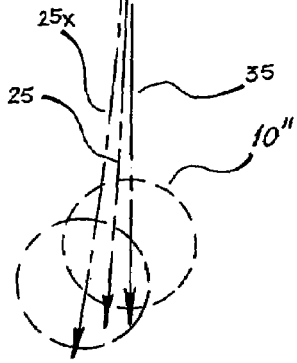
Fig.~3
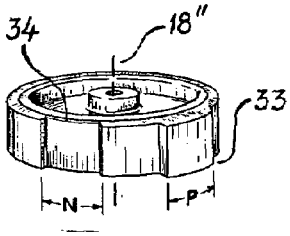
Fig.~4
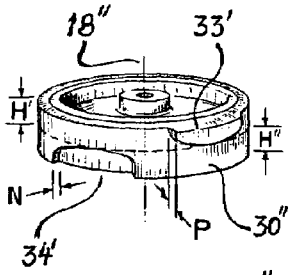
Fig.~7
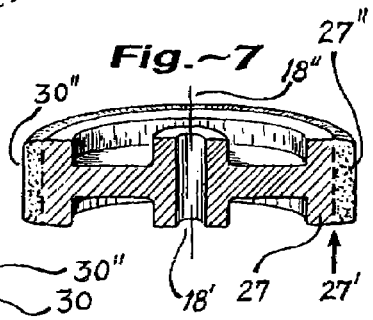
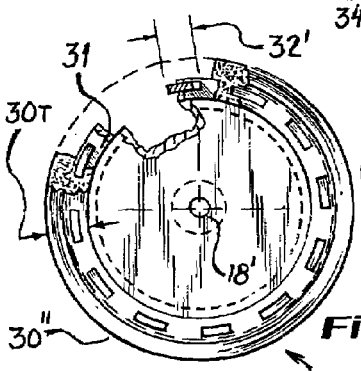
Fig.~5
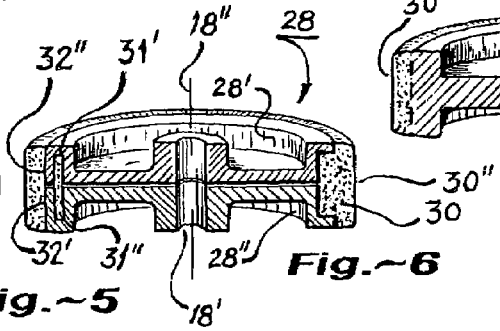
Fig.~6
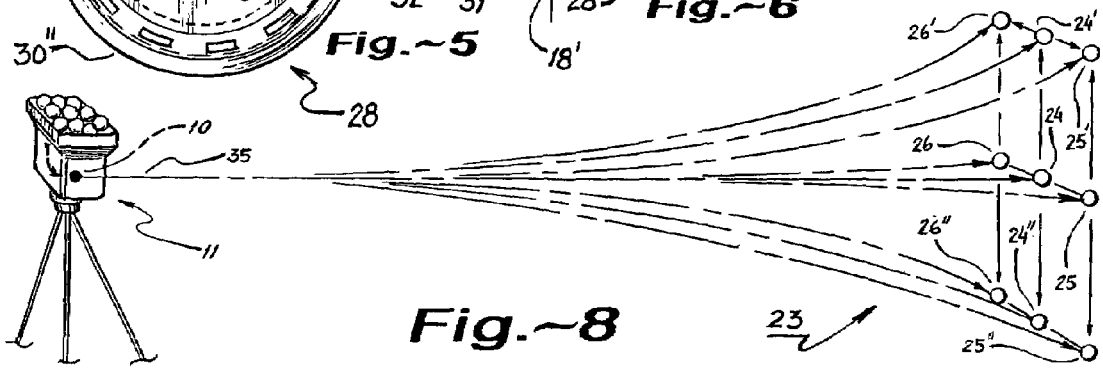
Fig.~8

IMPETUS-MODIFYING THRUST-WHEELS FOR BALL-PITCHING MACHINES

I.) BACKGROUND OF THE INVENTION

1. Field of Invention

This invention relates to motor-driven oppositely arranged cooperative thruster-wheels of the type employed by commercially available ball/pitching-machines; and more specifically, it relates to those types of thruster-wheels capable of inducing varied trajectory dynamics into a launched ball.

2. Relevant Information

The purpose of ball/pitching-machines is that of a slave-pitcher which without tiring will throw a ball, be it generally a baseball (solid-core), or a light-weight commercially at available wiffle-ball (hollow-core with multiple surface holes), toward an awaiting ball-batter (hitter); as to thereby enable the ball-batter to thereby with earnest practice, toward gaining improvement of their batting skill. Some ball pitching-machines are designed rather like a pneumatic-cannon, and as such tend to propel the pitched-ball without a particular bias of spin; while the type of ball pitching being addressed herein is one designed to replicate a ball-trajectory more akin to that characteristic imparted by the human-hand (ie:—a pitcher's own unique signature of thumb, fingers, and knuckles). This then can result in different styles of pitching, such as are oft characteristically designated by an observant baseball-game announcer as: an "inside" or an "outside"—"curve-ball", a "slider", a "fast-ball", a "drop-ball" (aka: "change-up"), according to the degree of so-called "english" or rotational-inertia a skilled if inspired pitcher's hand, arm, and body coordination dynamics can manage to induce into the resultantly flung ball. The pitching machines are often supported upon tripod-like stands, which are adjustable as to their height, azimuth, elevation, and speed of ball launching;—of which only velocity materially alters the ball's flight trajectory, while pitcher "induced spin" is capable of effecting trejectory (beyond those given effects of: gravity, air-density, wind-direction, & velocity). Accordingly, it has been thought advantageous by those skilled in the art of batting (as well as pitching), that to present pitched-balls having varied speeds and placement, while switching randomly between sorts of trajectory;—affords the best conditioning of a practicing ball-batter. However, such capability is not yet economically available, excepting perhaps in the very high-priced professional-league baseball pitching-machines. Many even expensive complex/pitching-machines require an attendant (or the batter themself) to periodically readjust the pitching-machine's thruster-wheels, so as to send a different signature of spin to the batter's strike-zone;—a rather static situation lacking of the desirably unpredictable personality of a skilled baseball-pitcher for example.

PRIOR-ART REVELATIONS

Background research discovery provides some prior patent-art regarded as germane to this disclosure, chronologically for example U.S. Pat. No. 4,197,827 (filed: November 1977 from Oregon, usa) contemplates a pair of coacting (cooperating) counter-rotating thruster-wheels outer periphery preferably of a polyurethane or vinyl elastomer having a Shore-durometer (index of material hardness) in the range of 30A–50A, each periphery configured with a concave tread-surface having a somewhat parabolic radial/cross-section; whereby the lateral-edges of the ball-impinging or "nipping" tread-surface thus engage the baseball's surface, and so necessarily spread apart as the baseball becomes progressively engaged between the axes of the spinning thruster-wheels. Hence, the inventor claims a straighter and faster precision launching of the baseball, which is therefore very predictable as to its aim.

In U.S. Pat. No. 4,442,823 (filed: March 1982 from texas) shows an elaborate and costly baseball pitching-machine having tripple/thruster-wheels (conventional pneumatic-tires) said to replicate any sort of pitcher's throw, wherein both the RPM's and angularity(relative to the line of propulsion) of at least one of the thruster-wheels can be regulated, plus the apparatus can measure the—humidity/barometric-pressure/air-temperature so as to make compensating adjustment.

In U.S. Pat. No. 4,632,088 (filed: February 1983 from Oregon) shows a dual-opposed thruster-wheel apparatus which object is somewhat the opposite of the preceding inventor's disclosure; wherein: a.) the respective rpm-rate of the thruster-wheels can be varied; b.) the diameters of the wheels can be different; c.) one thruster-wheel can be set slightly aftward relative to the other;—either of which variables are intended to impart a regular "curve-ball"—launching path which is consistent according to that particular setting selected, and which can therefore be anticipated by the receiving ball-batter during batting-practice. Such a launching system is especially useful by ball-batters who feel they must improve their performance in a particular sector of their swing (ie:—hi/low, inside/outside).

In U.S. Pat. No. 4,712,534 (filed: April 1986 from Japan) shows two pairs of counter-rotating thruster-wheels (four wheels total), the aftwardly arranged pair of which employ a central perimeter concave-groove serving to increase the frictional contact-area relative to the baseball's surface, while the frontal-pair of thruster-wheels employ a transversely-flat radial cross-section;—the double set of thruster-wheels said to thereby propel the ball at higher velocity without imposing excessive surface-wear of the ball.

In U.S. Pat. No. 4,760,835 (filed: October 1985 from Oregon) shows an opposed pair of counter-rotating thruster-wheels wherein the primary innovation resides in the mounting apparatus, enabling the thruster-wheels axies to be oriented at various angles between horizontal and vertical, so as to alter the trajectory of the ball.

In U.S. Pat. No. 5,832,909 (filed: October 1996 from Calif.) shows a ball-pitching machine having only a single thruster-wheel with a flat transverse cross-section of a resilent elastomeric material (such that the hub is polypropylene and the tire portion is a Sanoprene/synthetic-rubber), in combination with a variable-angle pitching-head;—the single spinning thruster-wheel designed to create a suction which draws the ball into the tubular-chute and thruster-aperture. Hence, while the resulting pitching-machine with its single/thruster-wheel has a built-in bias toward pitching balls toward one side,—although it can be reoriented to propel the ball into different sectors of the batter's strike-zone.

In U.S. Pat. No. 5,826,568 (filed: May 1997 from Texas) is shown a rather rudimentary softball-pitching machine having a single believed pneumatic-tire/wheel thruster-wheel; and as such is not very suited to usage with ball-batters, but perhaps well suited to just lobbing balls to the out-field for fielders catching practice.

In U.S. Pat. No. 5,865,161 (filed: January 1995 from Oregon) is shown a triple/thruster-wheel baseball pitching-machine, wherein the thruster-wheels are equally-spaced every 120-degrees around the ball as it enters the point of tangency with the wheels; each wheel having a discrete-motor drive, whereby varying of the relative motor speeds enables changing the trajectory of the baseball as to enter selectively different sectors of the batter's strike-zone by varying ball spin-rate and spin-direction.

In U.S. Pat. No. 5,897,445 (filed: February 1997 from Calif.) is shown an elaborate and costly professional batter's training pitching-machine, having an opposed pair of counter-rotating thruster-wheels which perimeters have a flat radial cross-section; but there are many allied features of the pitching-machine, such as remote-control of the respective drive-motor motor speeds to vary ball spin-direction, a pause mode, and video-recording.

In U.S. Pat. No. 6,182,649 (filed: March 1999 from Ct.) is shown an elaborate professional baseball or tennis-ball pitching-machine featuring three direct-drive thruster-wheels capable of launching a variety of different at less than 10-second intervals, without need of manually readjusting the machine;—selectively via a hand-held remote-control, or via pre-programmed repeat or random manner. Additionally, the allied apparatus includes a video-monitor enabling a batter to observe the pre-recorded pitching style of a particular pitcher the batter expects to soon be batting against;—and the pitching-machine is programmed to emulate the type of pitching throws that major-league pitcher is known for. However, such a machine as this is cumbersome, heavy, and not nearly within reach of most budget limitations.

Therefore, in full consideration of the preceding patent review, there is determined a need for an improved form of device to which these patents have been largely addressed. The instant inventor hereof now sets forth their newly improved thruster-wheel configuration for a ball/pitching-machine, the new device being engineeringly referred to as an asymmetric thruster-wheel, and commercially as the VARI-PITCH™ thruster-wheel, which is currently under development for production under auspices of SPC(Sports Products Consultants)-Mfg./Mkt.Co. SPC's VARI-PITCH™ exhibits certain advantages as shall be revealed in the subsequent portion of this instant disclosure. My commercially-available PersonalPitcher®-pitching-machine (mounting upon any tripod, and battery-powered to pitch balls at 4–6/second intervals) and allied products are all viewable at internet-erbsite: "www.personalpitcher.com".

II.) SUMMARY OF THE INVENTION

A.) In view of the foregoing discussion about the earlier invention art, it is therefore important to make it pellucid to others interested in the art that the object of this invention is to provide an improved friction-impeller type of thruster-wheel capable of generating novel variable trajectory dynamics, for retrofitable (or for new OEM) use by existing ball pitching-machines employing power-driven drive-axles (spindles) to which my new asymmetricly configured thruster-wheel is adapted either singly, or perhaps more preferably, as cooperating discrete counter(contra)-rotating pairs;—for ultimate use by practicing professional or amature ball-players (or Tennis-players for example), to sharpen their eye/mind/body-coordination relative to striking an approaching pitched ball. By configuring the perimeter of my thruster-wheel(s) tread-surface with preferably diametrically opposed (ie: thus providing inherent dynamic-balance) so-called impetus-modifying formations, I have discovered that my new IM/thruster-wheel can facilitate a low-cost method by which to effect various desirable influences upon the flight trajectory of the pitching-machine launched ball. These influences are deemed very desirable, since without troublesome repositioning or rotational-speed modification, the effect of my thruster-wheels is such that the robot pitching-machine is enabled to thereby rather mimic the variable-pitch trajectory from pitch to pitch,—in the natural cadence manner of a human ball-pitcher (and advantageously without usual otherwise interuption for manual or automatic readjustments)!

These novel impetus-modifying(IM) formations can be made upon the thruster-wheel's perimeter tread-surface in various ways, with a common characteristic being,—that however the IM-formations are designed, the IM-formation necessarily extends only a relatively few degrees of thruster-wheel rotation preferably across the entire transverse width of the thruster-wheel's tread-surface (or alternately,—located along the center, or lateral left or right thereof). Accordingly, various such IM/thruster-wheel design configurations will be made commercially available to our PersonalPitcher®-customers; possibly including prospective licensees,—also making pitching-machines of types already discussed previously herein.

There are two primary types of IM(impetus-modifying)-formations, one being referred to as a positive type, in as much as it is formed outwardly of the thruster-wheel's tread-surface; while the other is referred to as a negative type, formed inwardly of the tread-surface. A positive/IM-formation therefore essentially acts to increase the effective instant "radial-nip" of the thruster-wheel's point of friction upon the surface of the subject ball;—while a negative/IM-formation essentially acts to decrease the instant radial-nip of the thruster-wheel's point of friction upon the subject ball. Therefore, by simply selectively positioning these unique IM-formations upon the surface of the thruster-wheel, one can tailor a desirably surprising "change-up" characteristic of the launched ball,—which will virtually keep the batter wondering just what this world-class relentless slave-pitcher is going to throw at them next! Note that while installing of the outward(pos.) or inward(neg.) IM-formations is preferably accomplished during a thruster-wheel's production molding-process, it remains that the neg. or pos. IM-formations can also be installed during post-production as well;—either via partial grinding-away of the tire-tread's perimeter to form the desired negative/IM-formation, or via a bonded-on applique by which to form the positive/IM-formation (somewhat akin to the well known procedure of installing an intertube-patch).

In any case, my simple IM-formations result in providing the ideal change-up pitching action,—virtually eliminating need for any sort of heretofore complex user-controlled or computer-controlled readjusting-mechanism; and occurs because as the two thruster-wheels spin independently adjacent one-another (in the generally preferred embodiment, although this disclosure can work with one or more cooperating thruster-wheels as well) even if only one of the thruster-wheels is fitted with the IM-formations, and even if only a single preferably diametrically-opposed pair of IM-formations are employed. The batter has virtually no way of knowing which sort of pitched-ball will be launched from the thrust-aperature of the ball/pitching-machine at the instant one of the IM-formations happens to be spot-on "tangent" with the ball-surface, as to thereby frictionally impart a different spin rotational-direction and spin-rate, impetus to the ball. Therefore, resulting in (dependent upon which thruster-wheel is so equipped) launching an inside/curve-ball or outside/curve-ball toward the batter's upper or lower strike-zone for example (again dependent upon the positioning of the IM-formation, instantly impinging upon the tread-surface of the thruster-wheel). Hence, while the random occurrence of this action can (provided both thruster-wheel rpm's be about the same) theoretically if statistically be predicted mathmatically according to the number of IM-formations provided on a given thruster-wheel in terms of rotational-arc degrees, there is in reality no way of the batter knowing in "real-time" whether they are going to be pitched a "straight-arrow" fast-ball, or possibly a pitch at either the inside or outside, upper or lower, corners of their strike-zone.

While the principles involved in this instant disclosure are directly applicable to regular hard or soft baseballs, in my allied PersonalPitcher® pitching-machine I prefer use of conventional commercially-available perforated-surface hollow "Wiffle®-balls" (originally developed for golfing practice);—although any sort of hollow or solid-core ball can be likewise adapted. Accordingly, the criteria for employing Wiffle®-balls in my own pitching-machine product are: a.) owing its light-weight, youngsters practicing their batting-skills, do not have to be under adult-supervision, as to be hit in the head by a whiffle-ball poses no serious threat of injury; b.) the pitching-machine and associated thruster-wheels can be of relative light-weight lower-cost easy to transport construction,—practical for indoor or outdoor use day or night; c.) the existing surface perforations of a Wiffle®-ball provide excellent grabbing-action upon simultaneous nibbing of the opposed thruster-wheels; d.) it can be launched accurately toward batter's strike-zone from 15–28-foot distances at practical velocities of 20 mph to 45 mph,—which owing to its preferred smaller golfball-size makes for a smaller target looming toward the ball batter therefore in an overall psychophysiological manner simulating conditions encountered in trying to hit a full-sized baseball human-pitched at 90-mph from 60-feet; e.) they are very inexpensive, so at relatively little cost, four-dozen Wiffle®-balls can be compactly loaded into my pitching-machine's gravity-feeding carousel-hopper staged above the auto/feeding-chute; f.) being light-weight, a Wiffle®-ball does not subject the thruster-wheels tread-surface to as much wear as would a high-inertia baseball for example; and the low-inertia Wiffle®-ball thus has a relatively rapid launch/acceleration-rate enabling less-costly thruster-wheel drive-motors. However, this is my own product-design approach toward making low-cost hi-performance ball pitching-machines, and thus it is implicit that my impetus-modifying thruster-wheel principle hereof be understood to apply to pitching-machines for virtually all types of balls.

B.) Another object of this invention disclosure is to set forth an improved ball/pitching-machine thruster-wheel, generally employed as an oppositively cooperating pair, and wherein these novel IM/thruster-wheels may employ rigid left and rigid right lateral supporting hub portions, which facilitate mounting upon the power-driven discretely opposed and preferably axially-aligned respective left and right drive-spindles via preferably friction-fitting hub bore-centers. This simple method of mounting the thruster-wheels via friction interference-fit, enables the user to more readily manually interchange thruster-wheels, for example by simply pulling-off a conventional thruster-wheel as to thereby install my new IM/thruster-wheel (either of negative IM designated configuration, or of positive IM configuration;—or of both neg. and pos. impetus-modifying configuration).

Note here, that it is not within the purview of this invention disclosure to set forth the particular structural configuration of the herein considered pre-existing pitching-machine's drive-system design;—however generally speaking, the drivemotors are generally of the popular commercially-available brushless Permanent-magnet dc-type, whereto the drive-spindles to which my improved thruster-wheels are preferably directly mounted, are essentially an extension of the drivemotor's armature-shaft. Moreover, owing that identical drive-motors run at the same rpm for a given voltage/amperage-draw, the designer of the pitching-machine thus determines the proper application of electrical-current polarity (ie: −/+ or +/−) according to the particular juxtapositioning (ie:—whether motors are mounted one axle-up the other facing axle-down, both pointed axles-up, or both axles-down, etc.) of the respective two discrete motors in ultimately achieving the requisite cooperative counter-rotating action of the respective cooperative left/thruster-wheel and right/thruster-wheel friction impellers.

Accordingly, I prefer to employ a special injection-molded plastic supporting hub portion for my thruster-wheel, which as mentioned includes an axle-bore center sized precisely as to facilitate quick and easy manual press-on/pull-off method of attachment; wherein the axle-bore is an entirely circular interference-fit upon an entirely circular axle-spindle, in effect achieving a quasi slip-clutch like mounting via resilient preferably polyethylene-plastic hub portions (or if preferred they made with a flat-side, as to attain a positive/non-slip engagement of hub members upon the like flatted/axle-spindle).

This hub can be comprised of identical 2-piece mirror-image halves, having an integrally-formed transversely oriented circular segmented-flange defining continuous finger-like portions in transverse opposition as to thereby merge interposed through matching transversely oriented circular-groove formations provided upon opposite sides of the respective thruster-wheel's resilient tires. This simple albeit effective design therefore assembles to effectively lock the tire portion within the confines of the opposed hub halves, leaving only the radially outermost tire-tread portion (generally about ¾"-wide×about ⅛"-thickness) exposed for functionally engaging with the presented ball;—and thereby negating centrifugal-force caused excessive radial-growth of the elastic tire portion, which can otherwise be prone to "throwing" of the tire portion during high-speed rotation of around 4,000-rpm for a generally preferred approx. 3"-diam. thruster-wheel (note: thruster-wheel diameter and its RPM can vary substantially,—according to engineering-design preference).

To achieve economical production-assembly of these three members (opposed hubs and tire), one can if preferred simply include a like set of indexing-pins and indexing-holes, which when one hub is reversed and axially reoriented 180-degrees to one another,—thereby engagingly interpose. Similarly, one hub can have the integrally-molded male indexing-pins, while the other mating hub can have the integrally-molded female indexing-holes; either arrangement thus facilitating simple snap-together assembly;—thereby in either case, also enabling one complete 2-piece hub-assembly to be realized from a single/plastic-mold. However, in practice, I have found that the inherent axial friction-fit of the opposed hub half-portions is actually sufficient to hold them fast in position relative to one another. Additionally, I have found that some amount of imbalance may be noticable when the two hub and rim half-portions are mated together (and spun to 4,000-rpm);—which imbalance can be generally neutralized by simply rotating the half-portions 180-degrees out of phase to one another.

However, it is more likely that the production thruster-wheel hubs will be of a lighter one-piece configuration, having a single central radial-web joining the inward hub to the outer rim, and preferably employing an integrally formed tire-tread portion which can be permanently fused to the rim via a commercially available injection-molding process referred to as "overmolding" (ie: the two different molding-compounds becoming merged intimately together once the still very hot hub portion has been initially molded). Accordingly, this integrally formed bonding technique also advantageously eliminates any heretofore problem with the tire portion wanting to radially pull away from the rim portion owing to centrifugal-force at high-rpm.

C.) Another object of this invention disclosure is to provide the user of a commercially-available ball/pitching-machine the option of relatively easily changing between a conventional symmetrical thruster-wheel, and a herein otherwise referred to "asymmetrical" thruster-wheel. A symmetrical thruster-wheel having either a smooth tire-tread surface, or a tread-surface which is provided with a regular tread-pattern such as is achieved by intermittent transverse grooving (in effect creating regular intermittent tread-cleats),—which surface treatment aids the bite or nip of the thruster-wheel upon the ball-surface. Accordingly, in this manner, the user can employ either a conventional symmetrical thruster-wheel on one drive-motor's axle-spindle, while the opposing drivemotor's axle-spindle can be fitted with an asymmetrical thruster-wheel, or both thruster-wheels can be an asymmetrical thruster-wheel according to this disclosure; thereby achieving total flexibility in mixing or matching of the thruster-wheels as to achieve their desired sort of pitching action in accordance with the particular sort of batting practice needed.

III.) DESCRIPTION OF THE PREFERRED EMBODIMENT DRAWINGS

The foregoing and still other objects of this invention will become fully apparent, along with various advantages and features of novelty residing in the present embodiments, from study of the following description of the variant generic species embodiments and study of the ensuing description of these embodiments. Wherein indicia of reference are shown to match related matter stated in the text, as well as the claims section annexed hereto; and accordingly, a better understanding of the invention and the variant uses is intended, by reference to the drawings, which are considered as primarily exemplary and not to be therefore construed as restrictive in nature; wherein:

FIG. 1 (Prior-Art), is a vertically exploded perspective-view, favoring the frontal upper-right portion of a basic commercially available ball pitching-machine, which is provided for general reference as to thruster-wheel installation;

FIG. 2, is a multi-sequence diagrammatic upper/plan-view showing a pair of impetus-modifying type thruster-wheels arranged in normal bilateral opposition to a central ball feeding chute, and including a progression (A.) showing an instantaneous glimpse of one thruster-wheel impetus-modifying formation (B.) momentarily impinged upon a given exemplified ball, plus a further progression (C.) thereof showing the ball emerging freely forward of the IM/thruster-wheels, and resultant biasing off of from the central-line of projection;

FIG. 3, is a pictorial oblique perspective view showing one side of an assembled hub and tire relative to a drive-spindle axis of rotation, and including two circumferentially spaced apart exemplified type impetus-modifying formations N(negative) and P(positive);

FIG. 4, is a pictorial oblique perspective view showing one side an assembled hub and tire relative to a drive-spindle axis of rotation, and including two circumferentially spaced apart exemplified type impetus-modifying formations N(negative) and P(positive) relative to approximate half tread-width demarcations H' and H";

FIG. 5, is a diametrical cross-sectional view exemplifying a preferred permanently unitized wheel-assembly, wherein the wheel-hub and tire are formed in one-piece via a conventional two-step injection-molding process which thermol-blending transition region is indicated via phantom-lines proximal the perimeter;

FIG. 6, is a diametrical cross-sectional view exemplifying an alternate three-piece wheel-assembly, wherein radially arranged transverse-tabs are interposed within the tire-body for positive high-rpm retention;

FIG. 7, is an axial-plane plan-view according to FIG. 6, further revealing the relationship between the transverse-tabs and their transversely receiving tire-slots, and including a bite-like cutaway portion for greater visual clarity;

FIG. 8, is an upper-oblique pictorial-view showing a conventional ball/pitching-machine (adapted with the special IM/thruster-wheels hereof) relative to an exemplified regulation baseball batter's so called Strike-zone (which in practice is traditionally modified by Umpires to a horizontal rather than vertical format).

IV.) ITEMIZED NOMENCLATURE REFERENCES

First Fifteen Items Are Prior-Art Features

10,10',10"—ball (three exemplified static), emerging ball, thrusted ball

11—Exemplified Pitching-machine apparatus

12,12',12"—main-housing, containment-area, ball holding-tray

**13,13',13",13*x***—carousel-unit, drive-motor, ball-inlet, rotary-axis

14—ball drop-aperture

15—supporting utility-platen

16—rechargable-battery

17,17',17"—left-wheel drive-motor, drive-spindle, rotational-axis

18,18',18"—right-wheel drive-motor, drive-spindle, rotational-axis

19—left thruster-wheel (showing preferred regular tread pattern)

20—right thruster-wheel (showing preferred regular tread pattern)

21,21',21"—feeding-chute, lateral guide-rails, pitching-aperture

22,22'—off/on-switch, ball-ready indicator-lamp

23—existing batter's strike-zone

24/24'/24"—center type pitches: (not vearing): mid/high/low

New Invention Art Features

25/25'/25"—inside type pitches (vearing left): mid/high/low

26/26'/26"—outside type pitches (vearing right): mid/high/low

27,27',27"—IM/thruster-wheel integrated tire/hub: hub, transitional-region, tire

28.28'/28"—IM/thruster-wheel tire/hub assy., optional half portions: 1st-half/2nd-half

29,29',29"—left IM/thruster-wheel assy., tire body, basic tread-surface

30,30',30",30T—right IM/thruster-wheel assy., tire body, basic tread-surface, thickness

31/31',31"—IM/tire circular-groove: 1st-side/2nd-side, segmented-webs

32'/32"—IM/thruster-wheel hub circular-flange segments: 1st-half/2nd-half

33/33',33"—pos./IM-formations: centered/laterally offset, diametrically opposed

34/34',34"—neg./IM-formations: centered/laterally offset, diametrically opposed

35—theoretical longitudinal-axis ref.-projection (no gravity induced trajectory)

V.) DETAILED DESCRIPTION OF THE PREFERRED EMBODIMENTS

Toward clear understanding as to how this instant invention disclosure serves to benefit its user, Initial reference is given by way of FIG. 1, wherein is shown an exploded rudimentary view of a commercially available pitching-machine (approximating my existing product known as the Mk-I/PersonalPitcher®) 11 exhibited here as to exemplify a basic prior-art apparatus capable of utilizing my new IM(impetus-modifying) thruster-wheel device. The purpose of the pitching-machine apparatus 11 being to ultimately propel a single ball 10 from a pitching-aperture 21", as is shown emerging 10' thrusted as a precision pitched ball 10". In use, the apparatus is usually mounted securely down upon a supporting tripod (unshown,—but of a sturdy type such as commonly made for convenient fixed support of a camera), and a number of balls 10 are loaded into the holding-tray 12". In this pitching-machine design, a drive-motor 13' rotates carousel-unit 13 employing a ball-inlet aperture 13", delivering individual balls sequentially down a ball drop-aperture 14 where the ball falls into an L-shaped feeding-chute 21 (not shown in FIG. 1) where it lands and rolls forward on the lower-leg of the L-shape between the dual opposed rapidly spinning tread-surfaces left 19' and right 20' of the thruster-wheels (here shown elevated above the main-housing 12 for visual clarity). The thruster-wheels are rotated by rotational-axis 17"(left) and 18"(right), and are typically discretely driven by separate drive-motors 17(left) and 18(right), and in this example are compactly secured to common supporting-platen 15, which in this iteration also efficiently serves as a printed-circuit board for the drive system's electronic components powered by rechargable-battery 16. An off/on-switch 22 activates the apparatus, while the regular progression of balldrop events is announced to the awaiting ball-batter via simple full-on or full-off illumination of indicator-lamp 22', whereby the batter quickly becomes poised to swing at a promptly pitched ball when the light comes on (hence, when the balls in the holding-tray 12" have all been pitched the indicator-lamp 22' no longer activates. Accordingly, in such conventional pitching apparatus, the balls being consecutively pitched from pitching-aperture 21' are essentially all alike in their trajectory (excepting in the case of the more elaborate, and hence necessarily far more costly, pitching-machines revealed in the earlier background of this invention);—therefore, as one can now better understand, there is a need for an ultimately simple albeit highly effective way of more realistically emulating the natural dynamic pitching varity of a actual human pitcher.

There remain subtle if vital differences, which are to now become herein more evident and understood as important improvements as in FIG. 2, wherein are shown two laterally opposed IM/thruster-wheel assemblies 29(left) and 30(right), each having a preferably plastic concentric hub portion 27(left) and 28(right) respectively; which IM/thruster-wheels are here understood to be freely-spinning at high-rpm,—owing that actuator-switch 22 is "on". While phantom-outlined ball 10 shown at action/ref.arrow-"A" is approaching these spinning IM/thruster-wheels, the ball rolling here upon the lower-leg of the L-shaped gravity feeding-ramp 21 having left and right guide-rails 21', which maintains desired entry positioning of ball 10. The next progression of ball 10, is exemplified via advanced ball action/ref.arrow-"B" as having become instantly impinged between the opposing elastomeric tread-surfaces 29" and 30" of respective IM/thruster-wheel assemblies 29 and 30, whereto the left tire's elastomeric tread-surface 29" (although preferably having cross-grooving as indicated in FIG. 1, is here simply shown as a smooth perimeter as to convey greatest visual clarity) also includes an exemplified positive type impetus-modifying formation 33, while the right tire's tread-surface 30' has an out of impingement (hence inactive) negative type IM-formation 34. Hence, the pos./IM-formation 33 of left tire body 29' happens here to be instantly impinged against the ball's surface as a random occurance, while the opposing normal(unmodified) tread-surface 30" portion of the right IM-thruster-wheel is also in full contact with the ball's opposite surface. Therefore, as the ball 10 becomes resultantly thrust forward via action/ref.arrow-C to phantom-outline position 10', it has also now been caused to spin here in a CCW(counter-clockwise) manner (as viewed from above here) by the instant harsh nipping action of pos./IM-formation 33. But if for example, only the referenced neg./IM-formation of the right IM/thruster-wheel had been impinging upon the ball 10, while only the regular tread-surface 29" of the left IM/thruster-wheel, an inside (left biasing) pitched ball would still result (albeit less pronounced);—because of the lesser relative effective radius-arm caused by wheel-surface declivity or indentation 34" (hence an effectively slower surface-speed being presented upon the ball). Otherwise for example, had only the normal tread-surface portions 29" and 30" been simultaneously in contact with the ball's opposing surfaces (as here indicated only by right wheel 30), the ball would have been thrust outwardly without any pronounced spin, and thus travel in a conventional centered manner along indicated theoretical longitudinal-axis of reference 35. Note however in FIG. 2, that had the neg./IM-formation 34 of the right IM/thruster-wheel also been actively phased adjacent the ball's surface (ie: see 34" shown phantom outlined for reference only, an even more pronounced CCW/spin-rate would have been induced upon the emerging ball 10';—which would have been sending an extra emphasized "curve-ball" 25*x* toward the inside of a right-handed batter's strike-zone (note: as to avoid observer confusion hereof, these examples are all given consistently in terms relative to a regular "right-handed"—batter;—being that a left-handed batter's strike-zone inside/outside calls are just mirror-image reversed from that of FIG. 4 for example). Aerodynamically speaking, the resultant curving-path of a ball in flight being caused by the greater air-friction generated upon, the apparent faster-spinning side of the ball, as here compared to the right side of the ball spinning away from the forward flight,—hence having comparatively reduced surface-friction (ie: a non-spinning ball has a balanced amount of left and right drag, thus in still-air travels a straight-line as observed in plan-view). Moreover, in order to obtain an opposite right-bias to the pitched ball (to effect an outside type pitch), the positions of the negative and positive IM-formations would necessarily have to be just the opposite to that exemplified in FIG. 2;—that is to say, the left IM/thruster-wheel 29 might have its optional neg./IM-formation 34 staged against the ball 10, while the right IM/thruster-wheel assembly would have its optional pos./IM-formation 33 impinged against the opposite surface of ball 10.

Moreover, in actual practice, it has been found that a pitched ball will proceed in free-flight approximately half the distance to the awaiting batter, before the thus spun-ball's aerodynamics initially takes hold to draw the ball 10" into the progressively curving trajectories exhibited in FIG. 4 for example. This is why a skillfully pitched curve-ball can be so perplexing to a majority of batters, owing that in the batter's minds-eye, the early portion of the balls trajectory-appears to be proceeding toward their strike-zone on a fairly straight course;—thus while their mind's-eye is psycho-physiologically still computing to finally reassign the ball as a tricky curve-ball, their brain's-calculations have already progressed and advised them to take a swing at a seeming straight-ball! Often in mid-swing the batter realizes they have been duped to swing at a ball that is not at the place their mind's-eye had originally determined it should be;—that is, if all had gone as originally perceived a few brief hundredth's-of-a-second earlier! This explained seemingly aberrant "curve-ball phenomenon" is therefore paradisiacal as to why my invention disclosure hereof is so vitally helpful in hyper-coordinating a batter's mind's-eye, to more skillfully analyze the extremely subtle trajectory differences as a pitched ball is traversing its initial trajectory,—and necessarily before the brain-impulse is initiated which triggers the batter's muscles-memory to react in a particular manner or not!

Given further reference to FIG. 2, we see demonstration of the two laterally opposed IM/thruster-wheels 29 and 30 likewise understood to be counter-rotating at high-rpm, while a phantom-outlined ball 10 is shown via progression-"A" as approaching these IM/thruster-wheels. Thus at subsequent ball progression-"B'", we see the ball 10 exemplified as having instantly rolled within the opposing IM/thruster-wheels tread-surfaces, the left tire's tread-surface 30' (for visual clarity again simply shown as a smooth perimeter remiss of the optional regular transverse-grooved tread-pattern depicted in FIG. 1) here includes several negative type impetus-modifying formations 34, while the right tire's tread-surface 31' here includes several inactive positive type IM-formations 33. However, since only the neg./IM-formation 34 of the left tire 29 happens to be instantly impinged against the ball's surface as a random occurance, while the opposing normal(unmodified) tread-surface 30' portion of the right IM-thruster-wheel is in contact with the ball's surface,—then as the ball 10 becomes resultantly thrust forward to phantom-outline 10', it has also been caused to spin in a CW(clockwise) manner (as viewed here) by the instant nipping action of neg./IM-formation 34. Note however, that had a pos./IM-formation 33 of the right IM/thruster-wheel also been actively impinged against the ball's surface, an even greater CW/spin-rate would have been induced upon the emerging ball 10' (progression-"C'");—which would be sending an even more pronounced "curve-ball" toward the outside of a right-hand batter's strike-zone.

Illustration to FIG. 3 shows what could be either of the two left and right IM/thruster-wheels, but for purpose of convenience reference we shall identify it as right IM/thruster-wheel 30, wherein is included a central-hole for receiving drive-spindle 18', and particularly whereto is clearly exhibited both extreme opposite positive 33 and negative 34 full-width IM-formations; the designation-N serving to denote the generally preferred circumferential extent of an exemplified negative IM-formation, while designation-P similarly serves to denote the generally preferred circumferential extent of a positive IM-formation. It is important to understand however, that a greater or conversely lesser extent of IM-formation lengths "N" or "P" can be employed according to what can be aptly termed engineering-design preference.

Next, in FIG. 4 is shown another iteration of exemplified IM/thruster-wheel 30, clearly showing how the here negative 34' and positive 33' IM-formations can be merely partially formed at either lateral side of the tread-surface 30";—which generic variants of the basic FIG. 3 embodiments, thus function to induce still further dynamic changes of the launched ball's trajectory. In FIG. 4 the designation-N is used to indicate the radial-depth of the declivity 34', while the designation-P is used to indicate the radial-height of exemplified protuberance 33';—which can be formed again variously according to engineering-design preference, which exemplified depts and heights apply as well to the full-width IM-formations of FIG. 3 (while conversely, the lengths of the FIG. 4 IM-formations are to be treated in the same regard as the IM-formations of FIG. 3). Note also in FIG. 4 how the circumference of the tread-surface 30" is conveniently divided into half-portions via a phantom-outlined circumference-divisional reference, thereby indicating dual/circumferential-bands designated-H' and designated-H";—which imaginary division is merely a convenient way of defining the upper-half and lower-half of the IM/thruster-wheel. Moreover, in actuality the laterally-offset IM-formations 34' and 33' can either slightly exceed or slightly receed the basic H' and H" half-width apportions;—although the configuration shown in FIG. 4 is presently regarded as probably a best compromise relative to desired performance.

Accordingly, advancing our reference to FIG. 8 demonstrates how the trajectory of ball 10 can be randomly biased up/down and left/right according to the particular configuration of the FIG. 2 IM/thruster-wheels 29 and 30. For example, not withstanding the constant effect of gravity (not included in FIG. 8 owing to extenuating complexity of physics) a regular normally pitched (ie: straight) ball would follow path 35 and arrive at point 24;—but to induce the ball 10 to curve upward to point 24' or downward to point 24" for example, only the IM/thruster-wheel type revealed in FIG. 3 are thus installed as a pairs. Alternately, if the user or pitching-coach prefers, a mixture of regular and curved pitched balls can be programmed, simply by only installing the IM/thruster-wheel type shown in FIG. 4. However, if a randum mixture of regular and curved-pitches is desired; then the pitchin-machine is readily fitted with a pair of IM/thruster-wheels which would generally be characterized as being a FIG. 3 type at position 29 of FIG. 2, in combination with a FIG. 4 type installed at position 30 of FIG. 2. Thus, it can also be understood that the user can elect to install a conventional Thruster-wheel such as 19 or 20 of FIG. 1, in combination with a quick/change-up IM/thruster-wheel at either opposite paired position exemplified in FIG. 2; which would result in a higher percentage of regular pitches, whereby the curved-pitches would thereby bias the right or left side according to which side the IM/thruster-wheel were installed. My so-called quick/change-up IM/thruster-wheel is one which more universally combines all of the novel positive and negative IM-formation features on a single IM/thruster-wheeel. Thus, the ultimate in random change-up pitching-machine performance is therefore obtained by installing a pair of these IM/thruster-wheels, thereby sending the batter all six of the basic potential pitches of FIG. 8;—plus still further variant pitches thereof are possible when mixed with the three variant pitching-trajectories 25, 25*x*, and 35 of FIG. 2.

Next, in FIGS. 5 & 6 is shown a special 3-piece thruster-wheel construction, wherein as to address the problem of high-rpm centrifugal lift-away of the tire body from the wheel-rim, the hub half portions 28' and 28" are individually molded with a continuous circular plurality of spaced apart teeth-like retention tabs 32' and 32", the tire portion thereby including segmented aperture-webs 31" there between;—which cooperative relationships are perhaps best understood in the study of FIG. 5. Reference to FIG. 6 reveals how the laterally opposed wheel hub rims include transverse U-shaped rigid retention tab segments 32' and 32", serving to positively hold the tire 30' in place, yet facilitate quick and easy mounting and demounting of the tire body 30' relative to the abaxially apposed identical IM/thruster-wheel hub half portions 28' and 28". Although it is preferred that the plural segmented-tabs 32' and 32" be inserted entirely through the tire as shown, alternately if preferred an optional thin radial-web of tire-material may remain at the center-point where the two apposed circle of teeth like segmented-tabs interface. Moreover, it is to be understood that the IM-formation embodiments of FIGS. 3 & 4 are to be employed by the tire body 30 of FIGS. 5 & 6 as well as the integrally-molded tire body of FIG. 7.

Study of FIG. 7 shows an alternate and most preferred thruster-wheel embodiment, essentially of 1-piece injection-molded hub construction, wherein the circumferential elastomeric tire body 27" portion is best achieved as a post-molding operation usually via two separate injection-molding spews (one for the hub the other for the tire). Thus, just as the pre-sized moltant-glob of plastic-resin for the hub portion 27 has completed its injection entry within the conventional 2-piece mold (not shown), a secondary injection of the rubber-compound filling the tire 27" portion of the die-cavity is delivered;—thereby moltenly attaining a permanent fusing (inter-mixing of molecules) of the two materials along transverse transitional region indicated 27' in FIG. 7. Therefore, while the type-I segmented-tab gripping embodiment of FIGS. 5 & 6 is effective in mechanically preventing the tire body from being thrown from the hub-rim assembly 28, the type-II configuration of FIG. 6 is advantageously more intimately physically united whereby even the partial high-rpm inter-segmental separation is entirely eliminated.

Thus, it is readily understood how the preferred and generic-variant embodiments of this invention contemplate performing functions in a novel way not heretofore available nor realized. It is implicit that the utility of the foregoing adaptations of this invention are not necessarily dependent upon any prevailing invention patent; and, while the present invention has been well described hereinbefore by way of certain illustrated embodiments, it is to be expected that various changes, alterations, rearrangements, and obvious modifications may be resorted to by those skilled in the art to which it relates, without substantially departing from the implied spirit and scope of the instant invention. Therefore, the invention has been disclosed herein by way of example, and not as imposed limitation, while the appended claims set out the scope of the invention sought, and are to be construed as broadly as the terminology therein employed permits, reckoning that the invention verily comprehends every use of which it is susceptible. Accordingly, the embodiments of the invention in which an exclusive property or proprietary privilege is claimed, are defined as follows.

The invention claimed is:

1. An improved power-driven friction impelling thruster-wheel combination adapted to provide variable trajectory dynamics for a conventional ball/pitching-machine; said thruster-wheel combination comprising:

a set of two or more opposed thruster-wheels each with a resilient tread-surface portion and rotating on discrete drive-spindles aligned on a common radial-plane, at least one of said tread-surfaces including an impetus-modifying formation means upon its perimeter; whereby dependent upon the random positioning occurrence relationship of the driven said thruster-wheel tread-surfaces in which a said impetus-modifying formation can become laterally impinged momentarily against the surface of a given ball passing through the existing thruster-aperture of a conventional ball/pitching-machine, thereby providing an unpredictable ball-pitching trajectory event causing ball to arrive toward a ball-batter person at a desirably surprising region of their strike-zone.

2. The thruster-wheel device according to claim 1, wherein said thruster-wheels both include at least one diametrically opposed pair of said impetus-modifying formation means, thereby maintaining dynamic-balance of the spinning assembly.

3. The thruster-wheel device according to claim 1, wherein said thruster-wheels include at least one impetus-modifying formation means of the negative type made inward upon said tread-surface.

4. The thruster-wheel device according to claim 1, wherein said thruster-wheels include at least one impetus-modifying formation means of the positive type made outward upon said tread-surface.

5. The thruster-wheel device according to claim 1, wherein both said thruster-wheel hubs are of a mirror-image 2-piece construction, whereby integrally-formed transversely oriented circular-flange portions are arranged in transverse opposition as to thereby merge and seat into mating transversely oriented circular-groove formations provided upon opposite sides of respective said tires; thereby providing positive engagement as to thereby negate excessive radial-growth and throwing-loss of respective said tire portions during high-speed rotation.

6. An automated method by which to obtain a statistically predictable albeit random ball-pitching action, providing variable trajectory dynamics for a conventional ball/pitching-machine used by practicing ball-batters; said automated method comprising:

providing a pair of discretely opposed abaxially cooperating thruster-wheels rotating in opposite directions to each other on a common radial-plane, said thruster-wheels including a resilient tire portion and a rigid hub portion supported upon a descrete drive-spindle, at least one of said tires including a tread-surface adapted with at least one impetus-modifying formation means on its perimeter;

providing an unpredictable ball-pitching trajectory action via simultaneous bilateral impingement of said thruster-wheels tread-surfaces upon a given ball, whereby dependent upon random positioning occurrence relationship of driven said thruster-wheel upon which a said impetus-modifying formation becomes laterally impinged momentarily against surface of the ball passing through an existing thruster-aperture of a conventional ball/pitching-machine, said impetus-modifying formation means thereby exercising an irregular ball-pitching event causing ball to arrive toward a ball-batter person at a desirably surprising region of their strike-zone.

7. The automated irregular ball-pitching method according to claim 6, wherein said thruster-wheels optionally both include at least one diametrically opposed pair of said impetus-modifying formation means, thereby maintaining dynamic-balance of the spinning assembly.

8. The automated irregular ball-pitching method according to claim 6, wherein said thruster-wheel impetus-modifying means are made as a pair of diametrically opposed inward formations upon said tread-surface, or made as a pair of diametrically opposed outward formations upon said tread-surface.

* * * * *